United States Patent [19]

Lahr et al.

[11] Patent Number: 4,975,240

[45] Date of Patent: Dec. 4, 1990

[54] DOCKING ARRANGEMENT FOR CONNECTING A TRANSPORT AND STORAGE CONTAINER TO A RADIOACTIVELY CHARGED WORK CHAMBER

[75] Inventors: Helfrid Lahr, Wedemark; Bernd Pontani, Alzenau, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 344,701

[22] Filed: Apr. 28, 1989

[30] Foreign Application Priority Data

May 3, 1988 [DE] Fed. Rep. of Germany ..... 3814938

[51] Int. Cl.[5] ..... G21C 19/32

[52] U.S. Cl. ..... 376/260; 376/272; 414/146; 414/411

[58] Field of Search ..... 376/261, 260, 262, 272, 376/245, 340, 341, 342; 414/146, 217, 411; 250/506.1, 507.1

[56] References Cited

U.S. PATENT DOCUMENTS

| | | | |
|---|---|---|---|
| 4,228,864 | 10/1980 | Berger et al. | 414/411 |
| 4,260,312 | 4/1981 | Hackney | 250/506.1 |
| 4,281,691 | 8/1981 | Goutard et al. | 414/146 |
| 4,619,572 | 10/1986 | Lorenzelli et al. | 414/217 |
| 4,755,347 | 7/1988 | Tolmie | 376/272 |

FOREIGN PATENT DOCUMENTS 2836238 6/1980 Fed. Rep. of Germany .

*Primary Examiner*—Daniel D. Wasil
*Attorney, Agent, or Firm*—Walter Ottesen

[57] ABSTRACT

The invention relates to a docking arrangement for docking a transport container to a lock opening of a radioactively charged work chamber for loading and unloading radioactive materials. In order to dock the heavy transport container precisely at the lock opening and to reliably remotely manipulate the closure cover of the container, the lock opening is covered from within the work chamber by a bell-shaped closure device which can be removed inwardly. This bell-shaped closure device is laterally displaceable in the lock opening and is resiliently journalled and therefore can align itself with respect to the docked transport container.

11 Claims, 5 Drawing Sheets

Fig. 6
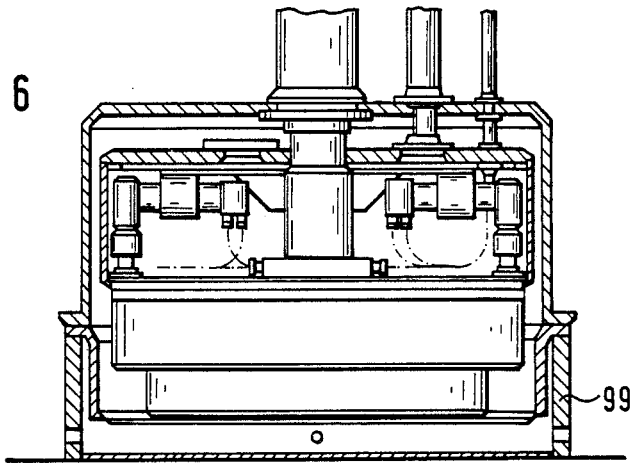
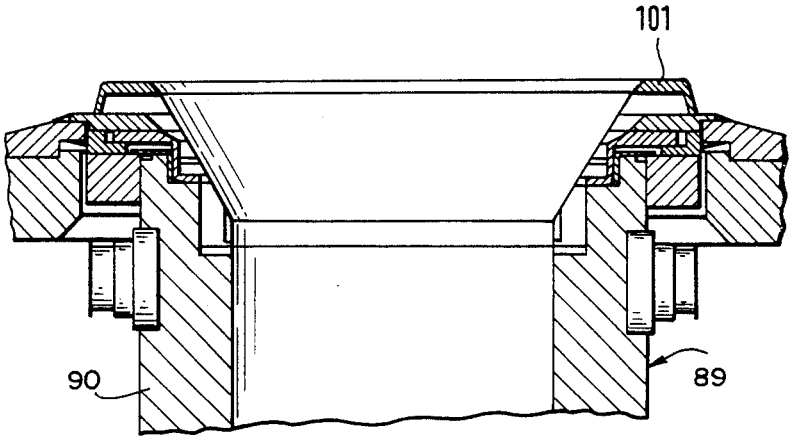
Fig. 7

DOCKING ARRANGEMENT FOR CONNECTING A TRANSPORT AND STORAGE CONTAINER TO A RADIOACTIVELY CHARGED WORK CHAMBER

FIELD OF THE INVENTION

The invention relates to a docking arrangement for connecting a transport and storage container to a lock of a radioactively charged work chamber for loading or unloading fuel elements, fuel rods or other radioactive materials. The loading opening of the transport and storage container is closeable by a cover system which includes a primary cover for gas-tightly enclosing the radioactive material.

BACKGROUND OF THE INVENTION

For the loading of storage drums receiving radioactive waste, it has long been known to connect these drums at their loading opening to a lock opening of a radioactive work chamber. For this purpose, use is made of the so-called double cover system which is known in many configurations.

Such docking or locking arrangements are not known for transport containers receiving the fuel rods or fuel elements. Furthermore, this technology can not be simply utilized without making essential changes since the transport and storage containers are containers weighing approximately 120 tons and the centering of which to the lock opening for the purpose of docking is most complicated. In contrast, the weight of a storage drum is commonly only approximately 1 ton.

SUMMARY OF THE INVENTION

It is an object of the invention to provide a docking arrangement of the kind described above by means of which a precise docking of a heavy transport and storage container is made possible and wherein the removal of the primary cover can be undertaken via remote manipulation and the outer surface of the primary cover is protected against contamination.

The docking arrangement of the invention connects a transport and storage container to a dock leading to a radioactively charged work chamber and facilitates the loading or unloading of fuel elements, fuel rods or other radioactive materials. The loading opening of the transport and storage container is closeable by a cover system which includes a primary cover for the gas-tight encasement of radioactive materials. The docking arrangement includes a transport chamber which is provided beneath the work chamber wherein a lifting and lowering device is provided for the container. The work chamber has a base wall in which the dock opening is located. A bell-shaped closure device is seated from above in the dock opening and is liftable inwardly out of the dock opening and can be transported away within the work chamber. The bell-shaped closure device is displaceably and resiliently journalled in the dock opening. The bell-shaped closure device includes a chamber for receiving the primary cover therein, as well as means for manipulating and grasping the primary cover. Ring-shaped centering surfaces are provided on the container and in the dock opening and coact to finely align the bell-shaped closure device with the container.

The primary cover is removed only after docking. The closure device is sensitively centered to the heavy container by means of the compensating elements at the docking opening.

The transport and storage container to be docked is brought to the docking opening by means of a lifting and lowering device such as a hydraulic lift. By means of the ring-shaped centering surfaces, possible small alignment inaccuracies are compensated for in that the closure device can be laterally and resiliently displaced. This assures that the axis of the bell-shaped closure device adjusts to the container axis.

The primary cover is released from the vessel of the container via suitable means and then grasped and so placed upwardly in the chamber within the bell-shaped closure device that the cover surface is covered by the protective bell. The entire bell-shaped closure device can now be lifted upwardly out of the lock opening and be transported away to the side with the primary cover to a location next to the lock opening or to another suitable location within the radioactively charged work chamber. The loading opening of the container is now freely accessible from the radioactively charged work chamber so that the container can be loaded or unloaded.

After loading or unloading, the bell-shaped closure device is again seated in the lock opening and the primary cover is seated again in the loading opening with the primary cover being protected at its surface against contamination within the work chamber. The container which is now closed again can be moved away from the lock opening via the lifting and lowering device.

According to another feature of the invention, the bell-shaped closure device has an outer protective bell in which an inner protective bell is mounted so as to be vertically displaceable. With this configuration, handling means for manipulating the primary cover can be protected with respect to contamination in the so-called hot cell or radioactively-charged work chamber.

Pursuant to another feature of the invention, the inner protective bell is penetrated by a central guide column which is centrally and displaceably journalled in the base of the outer protective bell. By means of this configuration, the inner protective bell can be moved relative to the outer protective bell.

According to still another feature of the invention, the inner protective bell and/or the outer protective bell are provided with an air supply line and a venting opening covered with a filter. The chamber of the outer protective bell and/or the inner protective bell is subjected to a clean flow of air. By means of the overpressure which is obtained in this way, protection against contamination of the equipment present in the bell-shaped chambers such as the primary cover and the handling means is assured.

The bolting tools are arranged on a rotatable holding plate in the inner protective bell with the holding plate being rotatably and vertically movable with respect to the inner protective bell. With this feature of the invention, the bolting tools can be brought into use relative to the inner protective bell.

The bell-shaped closure device has a stationary guide conduit on its wall facing upwardly. A pull-off spindle is rotatably journalled in the guide column and has a spindle nut 50 which coacts with a displaceable guide column with the end of the latter having receiving means for the primary cover of the container. With this feature of the invention, the displaceable guide column is vertically displaced by the rotation of the spindle nut. The take-up means for taking up the primary cover are located at the end of the guide column. The take-up means can be moved toward or away from the transport container by means of the displaceable guide column.

The guide column lies on top of the spindle nut by means of an end plate. With this configuration, the guide column can be freely displaced vertically upwardly when the transport container is lifted and pressed against the cover receiving plate. It is then possible to drive the spindle nut so that it follows the end plate which has been displaced upwardly together with the displaceable guide column and the equipment mounted thereon.

According to another feature of the invention, the means for manipulating and grasping the primary cover of the container can include the take-up means in the form of a cover receiving plate at the end of the guide column which almost completely closes off the downwardly directed openings of the outer protective bell and the inner protective bell when the bell-shaped closure device is in its starting position. The cover receiving plate at the end of the displaceable guide column advantageously closes the chambers in the inner protective bell and the outer protective bell.

According to still another feature of the invention, the cover receiving plate is provided with through bores arranged on an outer hole circle with the through bores having an inner diameter configured for clamping the bolt heads to be threadably disengaged from the primary cover and several through bores are provided on an inner hole circle having a diameter less than the diameter of the outer hole circle for attaching the cover receiving plate to the primary cover. The through bores on the outer hole circle permit access to the attachment bolts of the primary cover with the bolting tools. The through bores on the smaller hole circle are used to insert attachment bolts therethrough which engage in corresponding thread windings in the primary cover and thereby attach the cover receiving plate to the primary cover.

The lock opening is provided with an exchangeable docking ring which is held so as to be laterally displaceable in a circularly-shaped guide slot. If the lock opening is provided with an exchangeable docking ring, then the docking opening can be adapted to different container diameters with the bell-shaped closure arrangement being provided with a corresponding other outer diameter. This can be achieved by means of an exchange of the adapter ring attached to the lower end of the outer protective bell.

BRIEF DESCRIPTION OF THE DRAWINGS

The invention will now be explained in greater detail with reference to the drawings wherein:

FIG. 6 shows the bell-shaped closure device with primary cover contained therein seated on a stand within the hot cell at a location spaced a distance away from the lock opening; and, FIG. 7 shows the vessel of the container at the lock opening and provided with an apron to protect the docking and storage parts against contamination.

DESCRIPTION OF THE PREFERRED EMBODIMENTS OF THE INVENTION

Figure 1:
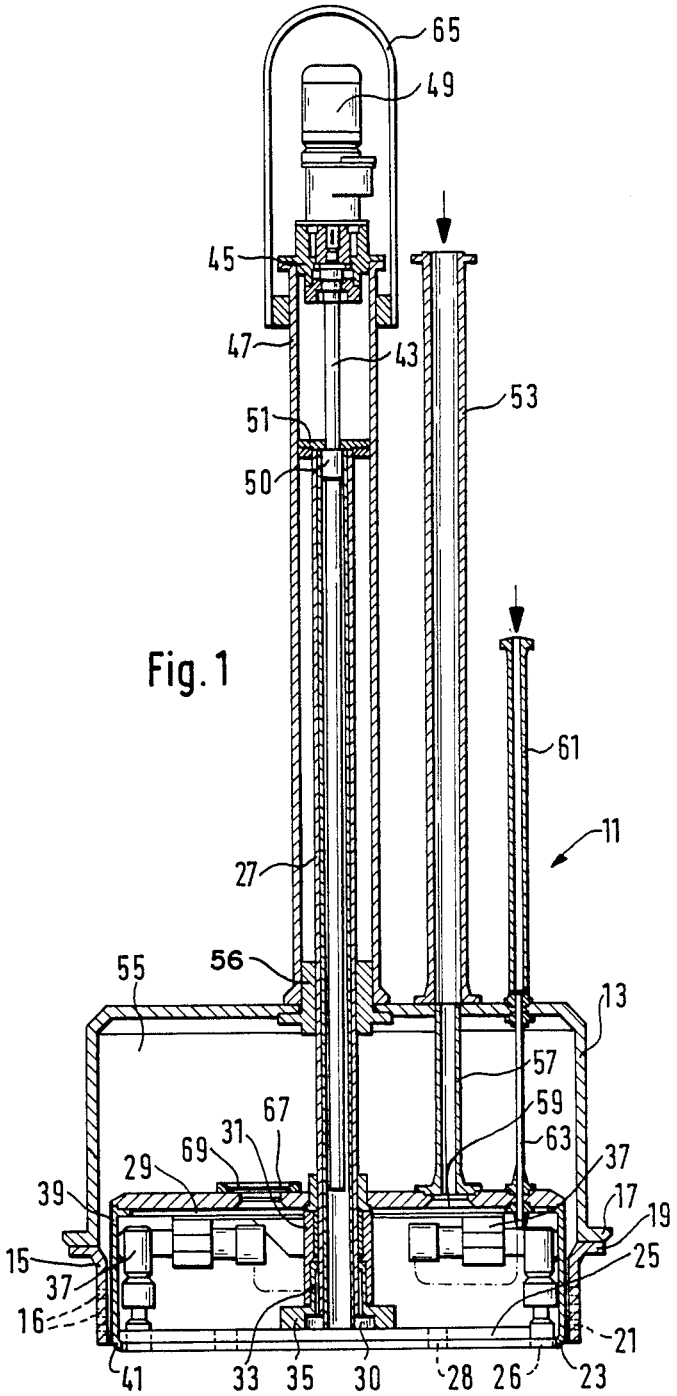
FIG. 1 is a side elevation view, partially in section, of an embodiment of the bell-shaped closure device of the docking arrangement according to the invention; and, FIGS. 2 to 7 are a sequence of views showing the steps of docking a transport container at a lock opening in which the bell-shaped closure device of the docking arrangement of the invention is utilized; more specifically.
Figure 2:
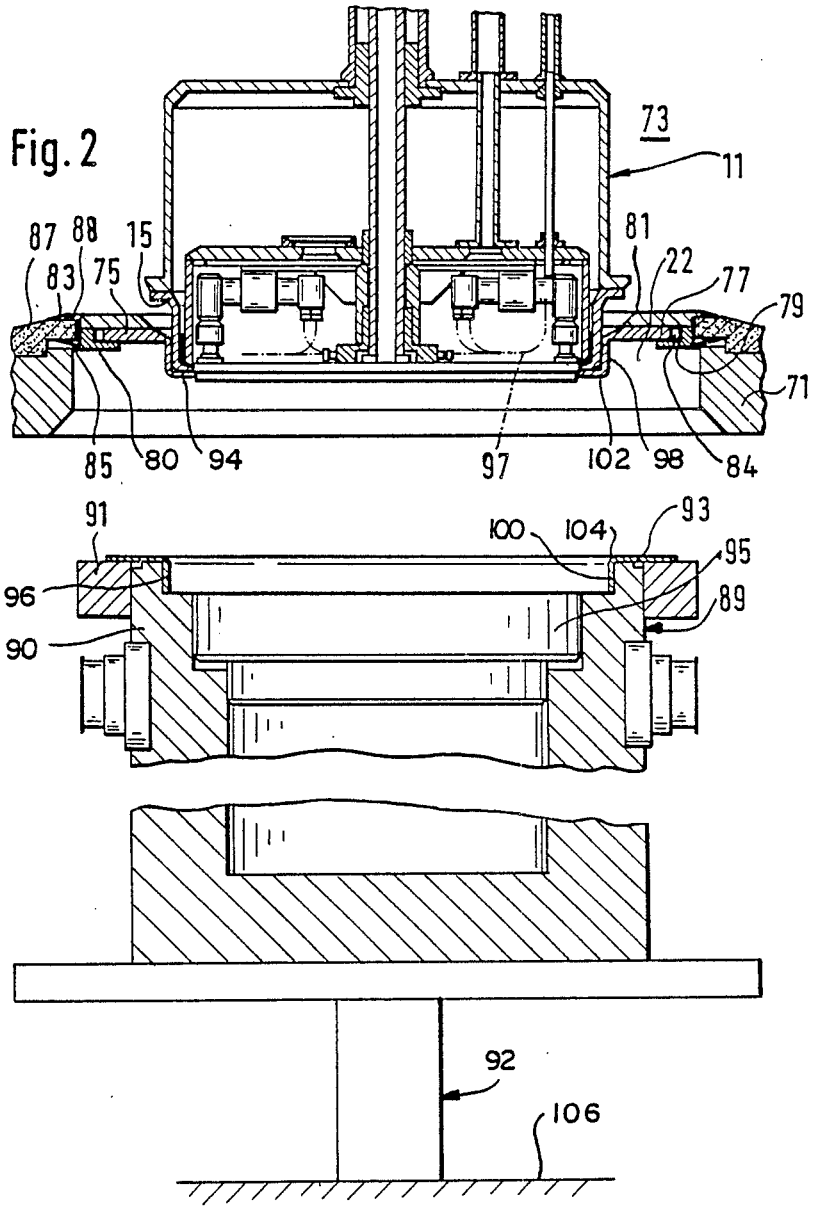
FIG. 2 shows the bell-shaped closure device after it has been placed in the lock opening.

The bell-shaped closure device 11 (FIG. 1) is seatable in a lock opening and has a downwardly directed outer protective bell 13 which is bolted to an adapter ring 15 via flange 17 and counterflange 19 with the adapter ring having radial bores 16 and a peripherally extending air filter 21. With the adapter ring 15, the bell-shaped closure device 11 is firmly seated from above in a form-tight manner in a correspondingly configured lock opening 22 (FIG. 2).

The adapter ring 15 extends inwardly at its lower end and defines a circular-shaped projection 23.

The lower opening of the bell-shaped closure device 11 is closed by a cover receiving plate 25. This cover receiving plate 25 is rotatably attached at the base of a guide column 27 via a roller bearing 30.

Through bores 26 lying on an outer hole circle are provided in the cover receiving plate 25 with the hole pattern of these through bores 26 corresponding to the hole pattern of the attachment bolts of the primary cover for attaching the latter to the vessel of the transport container. On an inner hole circle, several further through bores 28 are provided in the cover receiving plate 25 which serve to attach the cover receiving plate 25 to the primary cover of the transport container.

Above the cover receiving plate 25, a holder plate 29 is fixedly mounted to a center hub 31. With its lower portion, the hub 31 extends over a guide tube piece 33 having a flange-like end 35 which is bolted to the cover receiving plate 25. The guide tube piece 33 is taken along upwardly by the end of the guide column 27. The holding plate 29 carries four bolting tools 37 which can be actuated via motor drives.

The guide column 27 penetrates an inner protective bell 39 which, in the starting condition, encloses the bolting tools 37 and lies with its downwardly directed rim 41 closely next to the side edge surface of the cover receiving plate 25. The guide column 27 projects through the outer protective bell 13 and is displaceably journalled in sleeve bearing 56 so as to be movable along the center axis of the bell 13.

A pull-off spindle 43 is mounted in the guide column 27 and is rotatably journalled at its upper end at a bearing location 45 of an outer tube 47 and has a motor drive 49.

A spindle nut 50 is mounted on the pull-off spindle 43. This spindle nut 50 runs up against a fixed terminal plate 51 of the guide column 27; that is, the guide column 27 thereby simply lies on the spindle nut 50 so as to permit the guide column to move upwardly relative to the spindle 43 in response to an upwardly directed force applied to the cover receiving plate 25 by the container as will be explained further below. By changing the distance of the spindle nut 50 to the spindle end 45, the concentric displaceable guide column 27 is driven in the axial direction.

The bell-shaped closure device 11 has an air feed line 53 which continues into the inner chamber 55 via a venting conduit 57. The venting conduit 57 is telescopically displaceable into the air feed line 53 when the inner protective bell 39 is moved upwardly relative to the outer protective bell 13. The venting tube 57 is attached with the lower end thereof to the inner protective bell 39 and is aligned there with an opening 59 which is provided in the base of the inner protective bell 39.

Compressed air can be guided to the drives of the bolting tools 37 via a compressed air line 61 having an intermediate tube 63. The tube 63 is telescopically displaceable into the line 61.

The bell-shaped closure device 11 has a crane hook loop 65 at its upper end to facilitate transport within the hot cell 73 via an overhead crane, for example.

In the base of the inner protective bell 39, a further opening 67 is provided which is covered with a filter 69 with respect to the inner chamber 55.

The bell-shaped closure device 11 is placed in the lock opening 22 (FIG. 2) which is located in the base wall 71 of the radioactively-charged work chamber 73. In this way, the adapter ring 15 lies in a form-tight manner in a downwardly chamfered docking ring 75 which, in turn, lies with an outwardly projecting flange 77 on a holder ring 79 so as to be laterally displaceable and is fixed from above by a chamfered closure ring 81. Holding ring 79 and closure ring 81 conjointly form a guide slot 84 within which the docking ring 75 is laterally displaceable. The holding ring 79 and closure ring 81 lie with their respective outer edges 80 and 88 against respective elastic sealing lips 85 and 83 which are attached to a concrete ring 87 which, in turn, lies on and is seated in the base wall 71. The sealing lips are made of elastic material such as rubber.

The docking ring 75 is displaceable in slot 84 with respect to the holding ring 79 and the closure ring 81. This movement within the docking opening 22 permits the closure device 11 to be finely aligned to the transport container to be docked. The holding ring 79 and the closure ring 81 are bolted to each other and are movable as a unit in elevation. The closure ring 81 has an outwardly extending annular flange 82 (FIG. 3) and lies with this flange on the concrete ring 87 and so transmits forces to the latter.

A shielding ring 91 is mounted on the vessel 90 of the container 89. The docking ring 75 and a shielding ring 91 are selected in correspondence to the diameter of the particular container to be docked and are mounted in order to adapt the closure device 11 and the docking opening 22 to different container diameters.

A protective ring 93 is attached to the shielding ring 91 which covers the end face of the vessel 90 and protects against contamination.

In the inner protective bell 39, flexible air connectors 97 are provided by means of which the bolting tools 37 can be supplied with compressed air.

The operation of the docking arrangement will be explained in more detail with respect to FIGS. 2 to 7.

FIG. 2 shows a transport container 89 which has been brought into place in a transport chamber beneath the hot cell 73. The container 89 is still closed with a primary cover 95. In the case of a double cover system, the upper secondary cover would have already been removed before bringing the transport container 89 into position. The primary cover 95 closes off the radioactive materials in a gas-tight manner and is only removed after docking.

The lock opening 22 lying above the container 89 in the base wall 71 of the hot cell 73 is closed off by means of the seated bell-shaped closure device 11. The transport container 89 is provided with the protective ring 93 and the shielding ring 91. The shielding ring 91 is mounted on the vessel 90 of the container 89 and coarsely adjusts the position of the container with respect to the lock opening 22 in the base wall 71.

The container 89 is lifted upwardly into the lock opening 22 thereby coarsely positioning the container therein. This upward movement of the container causes the container to also be pressed against the movable suspension of the bell-shaped closure device 11. With this upward movement, the primary cover 95 will engage the cover receiving plate 25 and can cause a slight upward displacement of the latter and the guide column 27 thereby lifting the plate 51 up from the spindle nut 50. A hydraulic lift 92 mounted in the base wall 106 of the transport chamber serves to lift and lower the container as required.

A fine adjustment of the closure device 11 vis-a-vis the container opening is provided by the lateral movement docking ring 75 in the guide slot 84. This lateral movement enables the downwardly extending annular projection 94 of docking ring 75 to enter the opening defined by the downwardly extending annular flange 96 of the protective ring 93 thereby permitting the centering surface 98 of the docking ring to coact with centering surface 100 of the protective ring to finely align the closure device to the container. The annular edge 102 at the lower end of annular projection 94 and the annular edge 104 of the protective ring 93 are rounded to facilitate engagement of the annular projection 94 into the annular opening defined by the centering surface 100. In this way, a fine alignment and centering of the container 89 to the bell-shaped closure device 11 and to the docking opening 22 is obtained. The bell-shaped closure device 11 now remains aligned to the container 89 by means of the position adjusted in this manner. After this alignment procedure, the container 89 is again lowered with the hydraulic lift 92.

Figure 3:
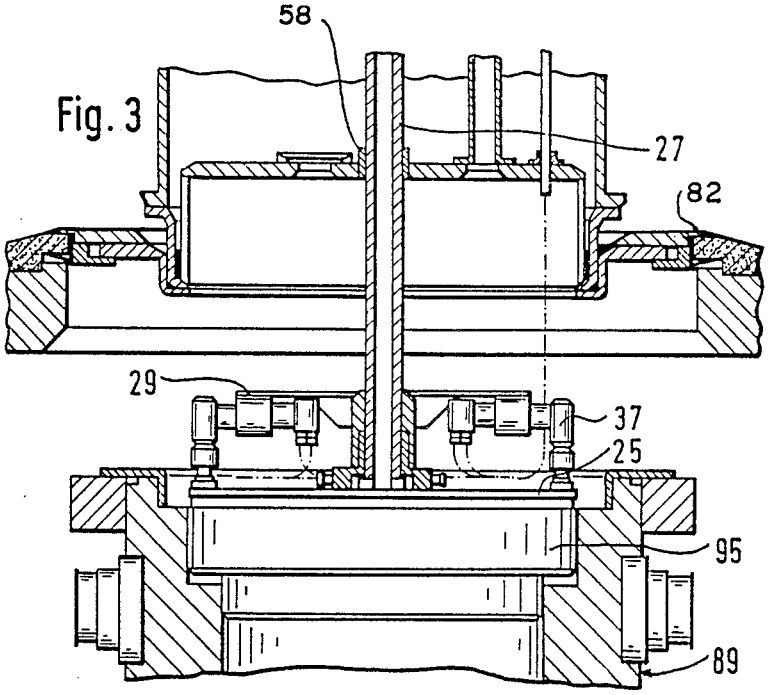
FIG. 3 shows the bolting device lowered into position onto the container so as to permit releasing the bolts securing the primary cover to the vessel of the container and to secure the primary cover to the cover receiving plate.

The bolting device (29, 37) is now lowered onto the transport container 89 as shown in FIG. 3. This lowering is achieved by the movement of the displaceable guide column 27 vertically in the downward direction through sleeve bearings 56 and 58. For this purpose, the pull-off spindle 43 is rotated until the cover receiving plate 25 lies upon the primary cover 95. The cover receiving plate 25 is attached by means of suitable threaded bolts which are inserted through the through bores 28 and screwed into corresponding thread windings in the primary cover.

The bolting tools 37 are guided through the through bores 26 by lowering the holding plate 29 and the cover bolts of the primary cover 95 are released by means of these bolting tools 37. The primary cover 95 conventionally has a diameter of approximately 1.5 m. There are about thirty bolts to be released from the primary cover 95. The four bolting tools 37 form a bolting cross and are mounted on the axis of the bell-shaped closure device 11. For this reason, four bolts can be released at one time. After releasing four bolts each time, the holding plate 29 is raised and the bolting cross is rotated further about the axis to position the same above the next set of attachment bolts to be released. This can be done manually since the space in the transport chamber beneath the hot cell 73 is shielded.

The release of the bolts according to FIG. 3 is performed with a spacing of the container 89 to the docking opening 22 to provide for a possible visual control.

Figure 4:
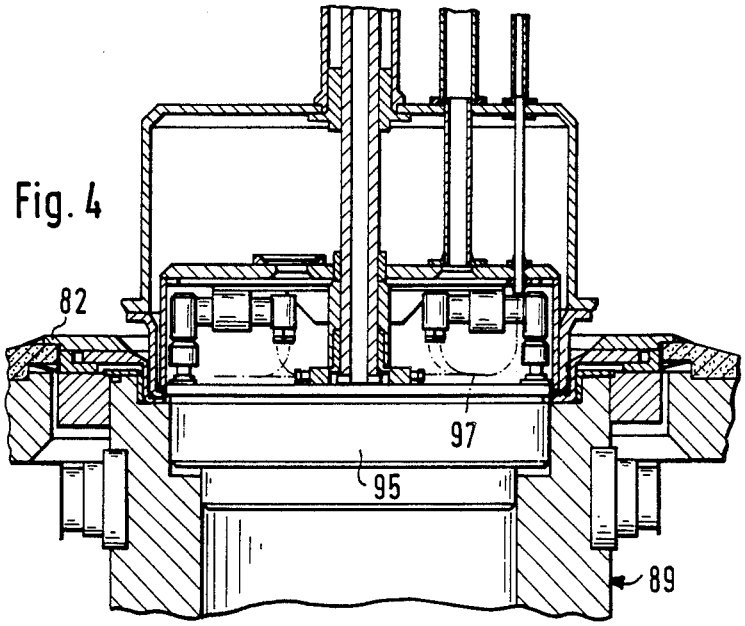
FIG. 4 shows the container raised to the docking opening preparatory to pulling the primary cover upwardly.
Figure 5:
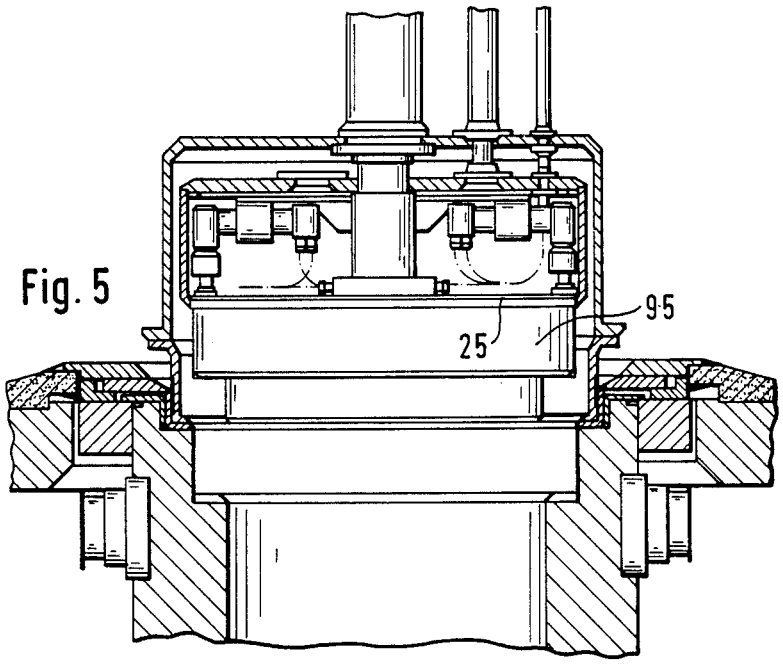
FIG. 5 shows the primary cover pulled upwardly and out of the vessel of the container.

The container 89 is again raised to the docking opening 22 together with the bolting device (29, 37) to the position shown in FIG. 4.

The primary cover 95 is now pulled upwardly (FIG. 5) via the pull-off unit, that is, the cover receiving plate 25 and the spindle arrangement (27, 43) are pulled upwardly and brought into the outer protective bell 13. The upper outer surface of the primary cover 95 can not be contaminated because it lies in the inner protective bell 39. The bell-shaped closure device 11 is charged with compressed air via the air supply line 53. The supplied clean air flows through the bell-shaped inner chamber and flows away again via the filters 69 and 21. An overpressure is obtained within the bell-shaped closure device 11 so that the radioactively charged atmosphere of the hot cell 73 can not penetrate into the closure device 11.

With a crane not shown here, the bell-shaped closure device 11 with the primary cover 95 disposed therein is raised upwardly out of the docking opening 22 and moved within the hot cell and put down on a holding stand 99 (FIG. 6).

As shown in FIG. 7, an apron 101 is now laid down into the opening of the vessel 90 of the container 89 in order to make loading and unloading secure. The apron 101 serves to protect the docking and storage parts from contamination.

The removal of the container 89 from the dock occurs in the reverse sequence.

It is understood that the foregoing description is that of the preferred embodiments of the invention and that various changes and modifications may be made thereto without departing from the spirit and scope of the invention as defined in the appended claims.

What is claimed is:

1. A docking arrangement for connecting a transport and storage container to a lock having a lock opening formed in a partition wall between a radioactively charged work chamber and a transport chamber in which the container is received, the container including a vessel defining an opening through which radioactive materials such as fuel elements and fuel rods can be passed for loading or unloading the container and a cover removably seated in said opening for gas-tightly sealing said materials in said container, the docking arrangement comprising:

lifting and lowering means disposed in said transport chamber for raising and lowering said container into and out of said lock opening;

a portable bell-shaped closure device disposed in said work chamber so as to be liftable and lowerable into said lock opening;

seat means for receiving said closure device in said lock opening; said seat means including an annular holder arranged on said partition wall in said lock opening; and, an annular seat member defining a seat for engageably receiving said closure device in said lock opening, said seat member being displaceably mounted in said annular holder for permitting a lateral displacement of said closure device within said lock opening and relative to said partition wall thereby facilitating an alignment of said closure device with the container;

said bell-shaped closure device having a chamber formed therein for accommodating said cover therein and including manipulating and engaging means for operating on and engaging said cover;

said annular seat member and the container conjointly defining an interface when said lifting and lowering means lifts the container into said opening;

centering surface means arranged at said interface for laterally displacing said annular seat member in said annular holder to effect said alignment of said closure device with said container; and, said manipulating and engaging means including displacing means for displacing the cover from the vessel and into said chamber.

2. The docking arrangement of claim 1, said closure device comprising an outer protective bell defining said chamber; and, said manipulating and engaging means including an inner protective bell; and, said displacing means being operatively connected to said inner protective bell for vertically displacing the latter relative to said outer protective bell.

3. The docking arrangement of claim 2, said displacing means comprising: a central displaceable guide column slideably journalled in said outer protective bell and extending through said inner protective bell; and, drive means for vertically displacing said displaceable guide column so as to bring the cover into said chamber.

4. The docking arrangement of claim 3, comprising: air supply means for supplying air to at least one of said protective bells to establish an overpressure therein; and, filtered opening means for allowing the air supplied to said one protective bell to escape therefrom at a rate sufficient to maintain said overpressure.

5. The docking arrangement of claim 3, said outer protective bell defining a first chamber and said inner protective bell defining a second chamber; and, said manipulating and engaging means including: a holding plate rotatably mounted on said displaceable guide column; and, bolting tool means mounted on said holding plate for operating on said cover; said displaceable guide column being movable by said drive means in the vertical direction relative to said inner protective bell between a first position wherein said holding plate and said bolting tool means is disposed within said second chamber and a second position wherein said holding plate and said bolting tool means is disposed downwardly of said inner protective bell for performing work on the cover.

6. The docking arrangement of claim 3, comprising an upwardly directed stationary guide column mounted on the wall of said outer protective bell for guiding said displaceable guide column therein; said drive means including a threaded pull-off spindle rotatably journalled in said stationary guide column; and, a spindle nut threadably engaging said pull-off spindle and operatively connected to said displaceable guide column for coacting with the latter to displace the same in the vertical direction; said displaceable guide column having a lower end; and, said manipulating and engaging means including take-up means mounted on said lower end of said displaceable guide column for taking up the cover of the container.

7. A docking arrangement for connecting a transport and storage container to a lock having a lock opening formed in a partition wall between a radioactively charged work chamber and a transport chamber in which the container is received, the container including a vessel defining an opening through which radioactive materials such as fuel elements and fuel rods can be passed for loading or unloading the container and a cover removably seated in said opening for gas-tightly sealing said materials in said container, the docking arrangement comprising:

lifting and lowering means disposed in said work chamber for raising and lowering said container into and out of said lock opening;

a portable bell-shaped closure device disposed in said work chamber so as to be liftable and lowerable into said lock opening;

seat means for receiving said closure device in said lock opening to permit a lateral displacement of said closure device within said lock opening;

said bell-shaped closure device having a chamber formed therein for accommodating said cover therein and including manipulating and engaging means for operating on and engaging said cover;

said seat means and the container conjointly defining an interface when said lifting and lowering means lifts the container into said opening;

centering surface means arranged at said interface for aligning said closure device to said container;

said manipulating and engaging means including displacing means for displacing the cover from the vessel and into said chamber;

said closure device including an outer protective bell defining said chamber;

said manipulating and engaging means including an inner protective bell;

said displacing means being operatively connected to said inner protective bell for vertically displacing the latter relative to said outer protective bell;

said displacing means including: a central displaceable guide column slideably journalled in said outer protective bell and extending through said inner protective bell; and, drive means for vertically displacing said displaceable guide column so as to bring the cover into said chamber;

an upwardly directed stationary guide column mounted on the wall of said outer protective bell for guiding said displaceable guide column therein;

said drive means including a threaded pull-off spindle rotatably journalled in said stationary guide column; and, a spindle nut threadably engaging said pull-out spindle and operatively connected to said displaceable guide column for coacting with the latter to displace the same in the vertical direction;

said displaceable guide column having a lower end;

said manipulating and engaging means including take-up means mounted on said lower end of said displaceable guide column for taking up the cover of the container; and, said displaceable guide column having an upper end and a terminal plate connected thereto at said upper end so as to rest on top of said spindle nut thereby permitting said displaceable guide column to be displaced upwardly and away from said spindle nut in response to an upward force applied to said lower end of said displaceable guide column.

8. The docking arrangement of claim 7, each of said protective bells having a peripheral edge defining a downwardly directed opening; said take-up means being a cover receiving plate mounted on said lower end of said displaceable guide column; and, said displaceable guide column being movable in the vertical direction relative to said protective bells between a first position at which said receiving plate closes off at least one of said downwardly directed openings in virtually a seal-tight manner and a second position at which said receiving plate is displaced downwardly from said first position so as to be at a predetermined distance from said protective bells.

9. The docking arrangement of claim 8, wherein the container includes a plurality of attachment bolts for attaching the cover to the vessel of the container; said cover receiving plate including a first plurality of through bores arranged along a first hole circle having a first diameter and corresponding to respective ones of said attachment bolts; said through bores each having an inner diameter configured so as to permit the corresponding one of the attachment bolts to be tightly holdable therein; and, a second plurality of through bores arranged along a second hole circle having a second diameter to facilitate the attachment of the cover to said cover receiving plate.

10. The docking arrangement of claim 1, said annular holder defining an annular slot; and, said annular seat member being mounted in said slot so as to be laterally displaceable therein for facilitating the alignment of said closure device with the container.

11. The docking arrangement of claim 10, said centering surface means comprising a first centering surface formed on said annular seat member and a second centering surface disposed on the container; and, said annular seat member being exchangeable to accommodate a container having a particular diameter.

* * * * *